US006142884A

United States Patent [19]

Yim

[11] Patent Number: 6,142,884

[45] Date of Patent: Nov. 7, 2000

[54] ADJUSTABLE GOLF PUTTER

[76] Inventor: Hyung Jin Yim, 43977 Beretta Dr., Fremont, Calif. 94539

[21] Appl. No.: 08/992,067

[22] Filed: Dec. 17, 1997

[51] Int. Cl.[7] ..... A63B 53/06

[52] U.S. Cl. ..... 473/248; 473/251; 473/314; 473/340

[58] Field of Search ..... 473/231, 238, 473/244, 245, 246, 247, 248, 251, 288, 305, 307, 313, 314, 325, 330

[56] References Cited

U.S. PATENT DOCUMENTS

| | | | |
|---|---|---|---|
| 4,735,414 | 4/1988 | Williams et al. | 473/248 |
| 4,815,740 | 3/1989 | Williams et al. | 473/248 |
| 5,244,205 | 9/1993 | Melanson et al. | 473/248 |
| 5,390,918 | 2/1995 | Meyers et al. | 473/246 |
| 5,429,356 | 7/1995 | Dingle et al. | 473/251 |
| 5,462,279 | 10/1995 | Culpepper | 473/251 |
| 5,716,287 | 2/1998 | Levocz et al. | 473/248 |

*Primary Examiner*—William M. Pierce
*Attorney, Agent, or Firm*—Milan Patel

[57] ABSTRACT

An adjustable putter which utilizes a putter head connected to an adjustment means. The adjustment means is connected to a shaft which is in turn connected to a grip. The relationship between the adjustment means and the putter head is maintained such that the lie angle of the putter head, with respect to the shaft, may be confined to certain measurements or restricitons. The putter may be customized to an individual's putting stroke and physical stature. The putter also benefits from the use of a striking face which is composed of two separate radial curvatures. The curvatures are connected smooth and piece-wise so that the continuous striking face is forgiving to putting inconsistencies.

10 Claims, 11 Drawing Sheets

ADJUSTABLE GOLF PUTTER

RELATED APPLICATIONS

Provisional applications 60-033365, 60-033189, 60-047313, 60-063007 and 60-065639 are incorporated herein by reference.

BACKGROUND

1. Field of Invention

This invention relates generally to golf clubs and more particularly to a lie adjustable golf putter and a putter head with a dual curvature face.

2. Description of Prior Art

The game of golf is generally known and has been around for many generations. It is a game of accuracy, wherein the accuracy is based on the lowest score possible. The score is determined by the number of strokes required to place a golf ball in a cup which resides on a putting green.

There are many factors involved in reducing a golfer's score. One of the biggest factors involved in reducing the score is the use of proper clubs, more particularly the golf putter. A novice would have difficulty in determining the proper golf putter. There are many factors involved in the determination of a proper putter. One of the major factors is the lie of the putter head which is based on the angle between the putter head and shaft and the height and the stance of the golfer. Another factor is the type of stroke used by the golfer. There are several types of putters on the market and a golfer may be able to find a golf putter to meet his or her needs. It is, however, rare that a golfer finds a putter that matches their exact needs without going through several putters. This can get very expensive. Nonetheless, over time the golfer will have improved his or her skills, changed their stance or a change in their physic occurs, thereby requiring another putter that meets their need. These changes usually occur in beginners and young players. Even professional golfers, however, change as they strive to lower their score.

Due to the foregoing problems, it is preferred that a golfer be provided with one putter that can be customized to their needs and that can be adjusted as the golfer changes. Furthermore, this putter should maintain the customized adjustment until the golfer chooses to change it. The adjustment of such a putter should be controlled such that the user need not worry about meeting the specifications of major associations, such as The United State Golf Association (USGA). This putter should also be provided with a putter head that has a dual curvature face to provide maximum use of the sweet spot of the putter, regardless of the type of stroke of a golfer.

There are several adjustable putters described in the prior art that allow the golfer to customize their putter.

For example, U.S. Pat. No. 5,580,051 discloses a golf putter whose design utilizes a gear-type tooth linkage pivot point on the shaft slightly above the head of the club. The main disadvantage with this design, and others similar to it, is that the gear type linkage allows only a certain finite amount of degree settings for the user to choose from due to the significant size of the teeth. This lack of true customization can preclude the player from setting his own desired lie angle. This type of linkage also creates an unnecessarily bulky structure around the shaft connection.

Also, U.S. Pat. No. 5,542,665 delineates another design which induces undesirable qualities. The shaft is connected to a hosel which then connects to the rear surface of the putter head, opposite the striking surface. The nature of the connection is one of a pivot which allows for an adjustable angle between the horizontal plane of the putter head and the shaft. Since the pivot point is placed on the rear surface of the putter head, however, the distance between the shaft and actual point of contact is greater than that of conventional putters and tends to produce the adverse feeling of pushing the ball rather than a slight pulling, which is the favorable consensus of the golfing community.

The design disclosed in U.S. Pat. No. 4,815,740 utilizes the putter's center of gravity as an ideal pivot point. This pivot is comprised of a circular array of like serrations which emanate from the defined pivot point. Another set of similar serrations are connected to the shaft by a hosel linkage. The two sets of radial serrations mate and are clamped together to form a semi-permanent angle between the horizontal lie of the putter head and the elongated shaft. A ring circumscribes the interface of the mating serrations to preclude any foreign matter from entering the space between the serrations. Though this design is well thought out in theory, it lacks the simplistic practicality desired by the greater mass of consumers. This design seems superfluously complex as it utilizes extraneous parts such as resistive springs and a circumscribing enclosing.

OBJECT OF THE INVENTION

Besides addressing the matters and problems above, the main objects of the present invention are:

(a) to provide a customized putting set-up with respect to an individual's personal physical build i.e. height, weight, stance, etc.

(b) to provide an adjustable putter which is convenient, simple, userfriendly, and has a pleasant aesthetic appeal.

(c) to improve a golfer's putting accuracy and consistency through proper customization.

(d) to provide an adjustable golf putter with a systematic lock that limits the adjustment according to the specifications of the major golf associations, such as the USGA.

(e) to provide a putter head with a dual curvature face for maximizing the use of the sweet spot of the putter, regardless of the type of stroke used by the user.

BREIF DESCRIPTION OF THE DRAWINGS

DETAILED DESCRIPTION OF THE BEST MODE

Figure 1:
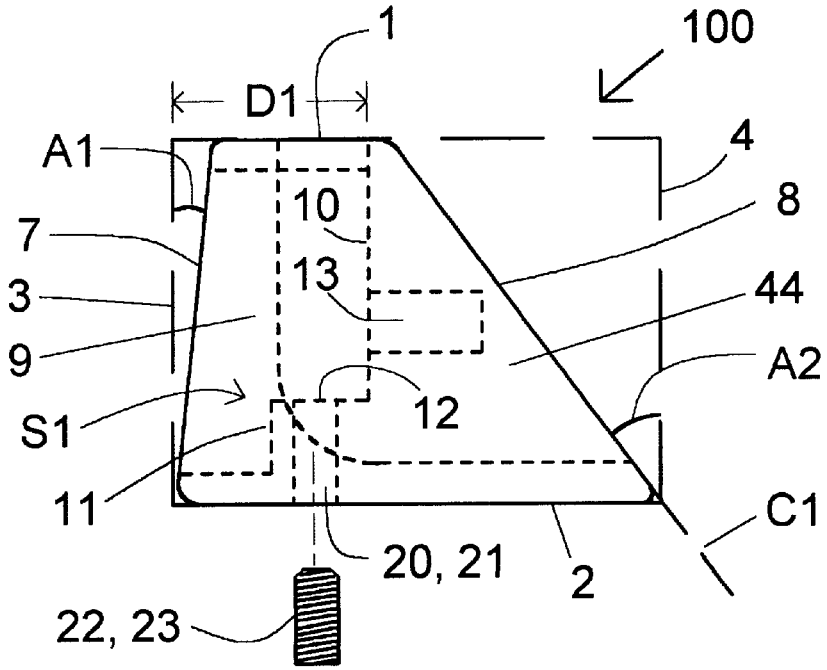
FIG. 1 shows a side view of the preferred embodiment of the putter head.

FIGS. 1–6 illustrate the preferred embodiment of the present invention. A golf putter 103 having adjustable capabilities, comprising a putter head 100 having a top surface 1, a bottom surface 2, a front planar surface 3 and a rear planar surface 4. The top surface 1 is generally parallel to the bottom surface 2 and the front planar surface 3 is generally parallel to the rear planar surface 4. The front and rear planar surfaces 3 and 4 are perpendicular to the top and bottom surfaces 1 and 2. The putter head 100 further having an outer forward portion generally known as the toe 5 and inner portion generally known as the heel 6 and all the surfaces 1, 2, 3 and 4 extend from heel 6 to toe 5. Also, as shown in FIG. 1, the putter head 100 is slightly rounded where the bottom surface 2 intersects with front planar surface 3.

The putter head 100 is constructed to have a striking surface 7 on the front planar surface 3 which forms an angle A1 of approximately three degrees with respect to the front planar surface 3. A rear surface 8 is formed opposite the striking surface 7 by a rear planar cut C1 with a rear angle A2 of thirty five degrees with respect to the rear planar surface 4. It should be noted that the angles of the striking surface 7 and the rear surface 8 are not a limitation of the invention. A rear side cavity 44 is formed into the rear surface 8 of the putter head 100 and is of a symmetrical shape with respect to a vertical axis. The cavity 44 is formed at the midpoint of the putter head 100 wherein the midpoint of the cavity 44 is aligned with the midpoint of the putter head 100. The cavity 44 alters the aesthetic value and distributes the putter head's 100 weight to the outside of the "sweet spot." It should be noted that the shape, size and location of the cavity 44 is for cosmetics and not a limitation.

A circular pocket 9 having a radius R1 and depth D1 for receiving an adjustment means H1, is formed at the striking surface 7 near the heel 6. The depth D1 is depressed horizontally on the striking surface 7. A step S1 protrudes from a back wall 10 of the pocket 9. The step S1 extends outwards, towards the striking surface 7, in a horizontal manner having an outer face 11 and an upper face 12 which are perpendicular to each other. The outer face 11 is parallel to the front planar surface 3 and extends upward generally half the radius R1 of the circular pocket 9 from circumference of the circular pocket 9. The upper face 12 is parallel to the bottom surface 2 and extends outward generally half the depth D1 of the circular pocket 9 from the back wall 10. A significant advantage is achieved by providing the extension of the upper face 12 such that the rotation of adjustment means is automatically limited to be within the specification of the major golf associates. A threaded axle hole 13, to receive an axle bolt 14, is formed at the back wall 10 of the circular pocket 9. A U-shaped opening 15 is formed for receiving a pole 16 of the adjustment means H1 is formed at the top surface 1 extending downward into the circular pocket 9. The distance between the walls 17 and 18 of the U-shaped opening 15 is sized to limit the rotation of the pole 16 to seven degrees in either direction from a vertical position. This is a significant aspect of the invention, because the user is automatically limited to be within the specifications of the USGA. The present embodiment utilizes a pre-bent shaft. It should be noted, however, that the limiting walls 17 and 18 of the U-shaped opening 15 may vary in their position and nature relative to different types of golf shafts so that the invention may remain within the specifications of the USGA. The connection between a shaft 98 and the adjustment means H1 is such that the pole 16 of adjustment means H1 is inserted into the hollowing of the shaft 98.

Figure 2:
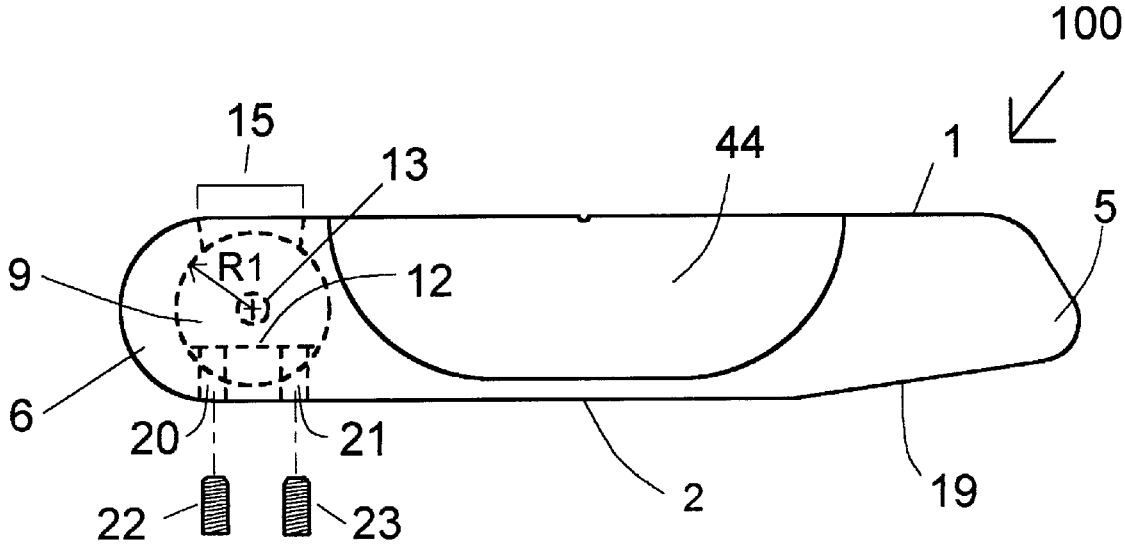
FIG. 2 shows a back view of the preferred embodiment of the putter head.

FIG. 2 shows the bottom surface 2 having a beveled upward portion 19 at toe 5 of the putter head 100. A rotation locking means comprises a plurality of threaded holes 20 and 21 are formed near the heel 6 of the putter on the bottom surface 2 for receiving lock screws 22 and 23. These holes 20 and 21 extend through the bottom surface 2 and open at the upper face 12 of the step S1 of the circular pocket 9 and are slightly off-centered to left and right of the circular pocket's 9 center axis. The use of the rotation locking means will aid the user from losing the adjustment and prevent unintentional twisting of the putter head 100.

Figure 3:
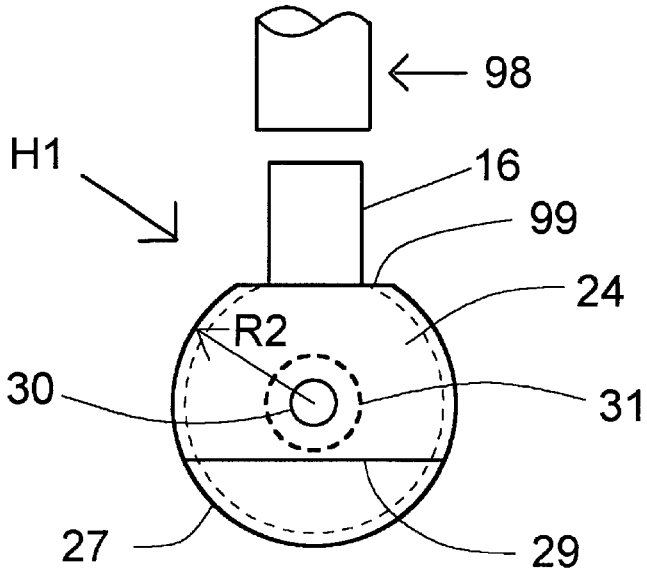
FIG. 3 shows a view of a inner face of the preferred embodiment of the adjustment means.
Figure 4:
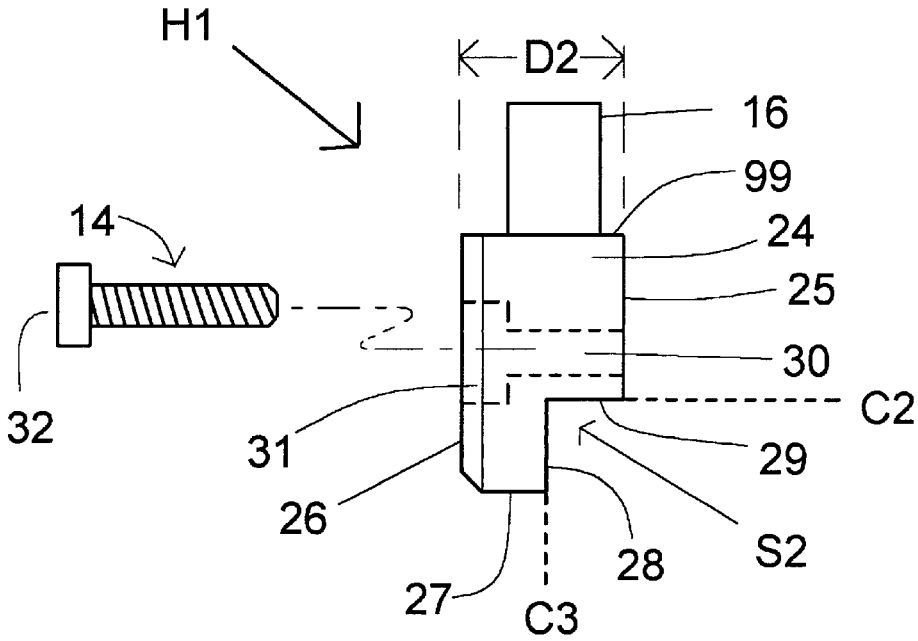
FIG. 4 shows a side view of the preferred embodiment of the adjustment means.
Figure 5:
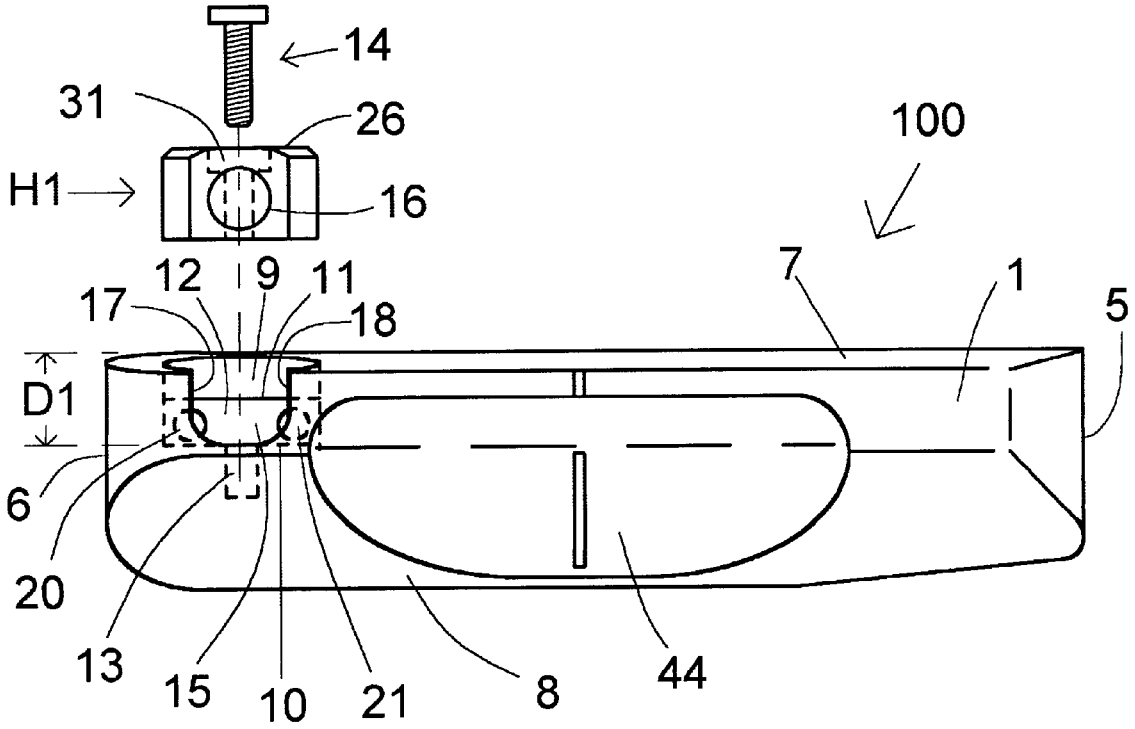
FIG. 5 shows a top view of the preferred embodiment of the putter head and the adjustment means.
Figure 6:
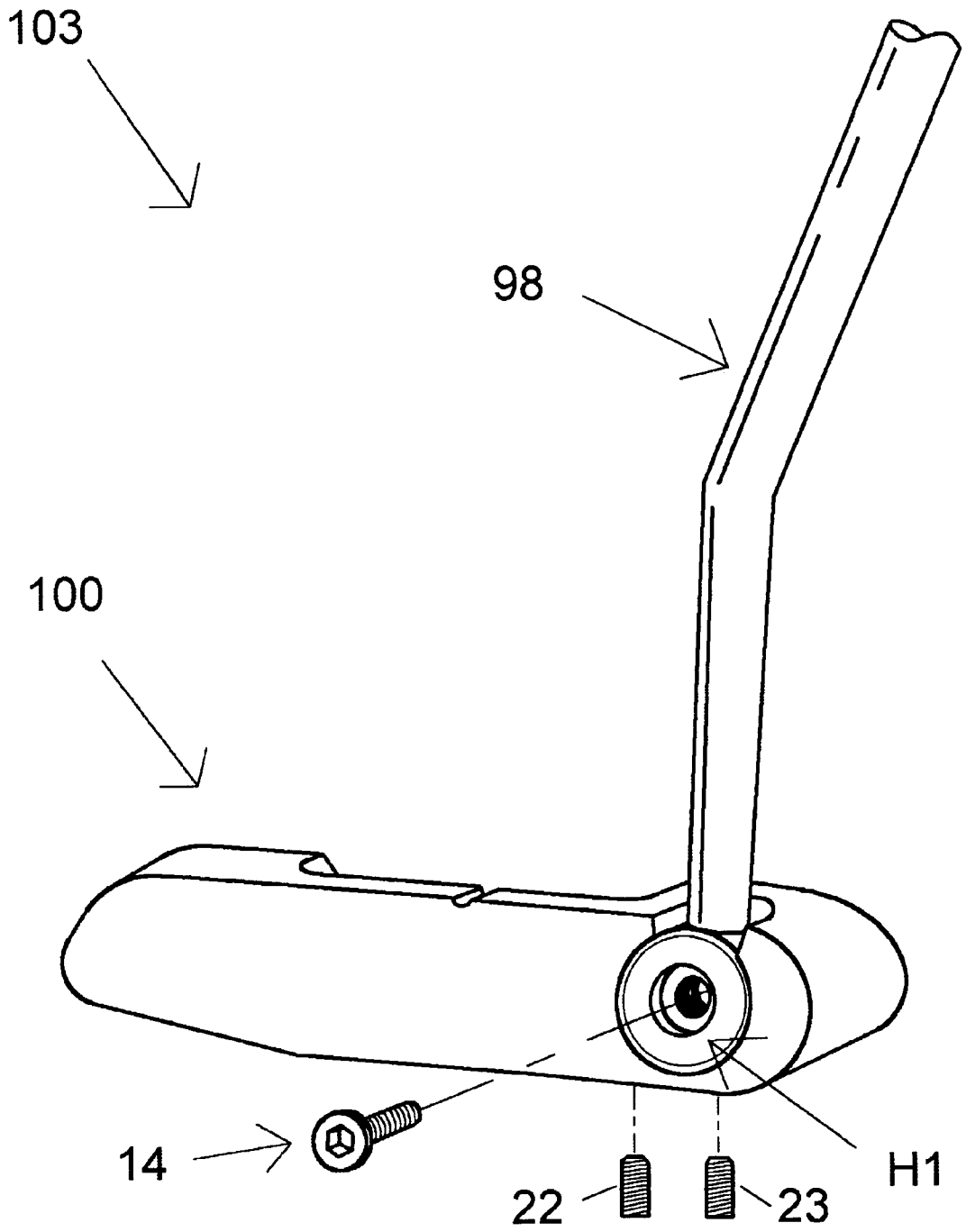
FIG. 6 shows a golf putter assembled with the preferred embodiment.

FIGS. 3 and 4 show the preferred embodiment of the an adjustment means H1. The adjustment means H1 comprises a disk 24 with an inner face 25 and an outer face 26. The disk 24 is sized to have a radius R2 slightly less than the radius R1 of the circular pocket 9 and a depth D2 equal to the depth D1 of the circular pocket 9 such that the adjustment means H1 is rotateably received inside the circular pocket 9 and flush with the striking surface 7. A flat portion 99 is provided on one side of disk wherein a cylindrical pole 16 slightly extends therefrom, such that the center axis of the disk 24 is perpendicular to the center axis of the cylindrical pole 16. Opposite to the extended pole 16 and the flat portion 99, the disk 24 includes a first and a second planar cut C2 and C3, which are perpendicular to each other at the inner face 25 of the disk 24 forming a depression S2 having a vertical face 28 and a horizontal face 29. The vertical face 28 extends from the radial surface 27 to a point that is substantially greater than half of the radius R2 of the disk 24 and less than the radius R2 of the disk 24. The horizontal face 29 of the disk 24 extends generally from inner face 25 to half the depth D2 of the disk 24. A center axle hole 30 is provided at the center of the disk 24 for receiving the axle bolt 14. The axle hole 30 having a countersunk portion 31 at the outer face 26 of the disk 24 such that the head surface 32 of the axle bolt 14 is flush with the outer face 26 of the disk 24.

To assemble the putter head 100, simply insert the disk 24 into the pocket 9 of the putter head 100 such that the extended pole 16 of the disk 24 is received between the walls 17 and 18 of the U-shaped opening 15. Secure the disk 24 by threading in the axle bolt 14 from the outer face 26 of the disk 24 through the center axle hole 30 of the disk 24 and into the threaded axle hole 13 of the pocket 9. Thread in the lock screws 22 and 23 into the holes 20 and 21 on the bottom surface 2 of the putter head 100. Once assembled, the user can begin making custom adjustments by loosening the axle bolt 14, then adjusting the putter head or loosing or tightening the lock screws 22 and 23 for custom adjustment. Once the proper lie angle is selected, the user simply tightens the axle bolt 14. An advantage of the these lock screws 22 and 23, is that the adjustment is maintained through a final tightening of the adjustment means to the putter head 100.

DETAILED DESCRIPTION OF THE SECOND EMBODIMENT

Figure 7:
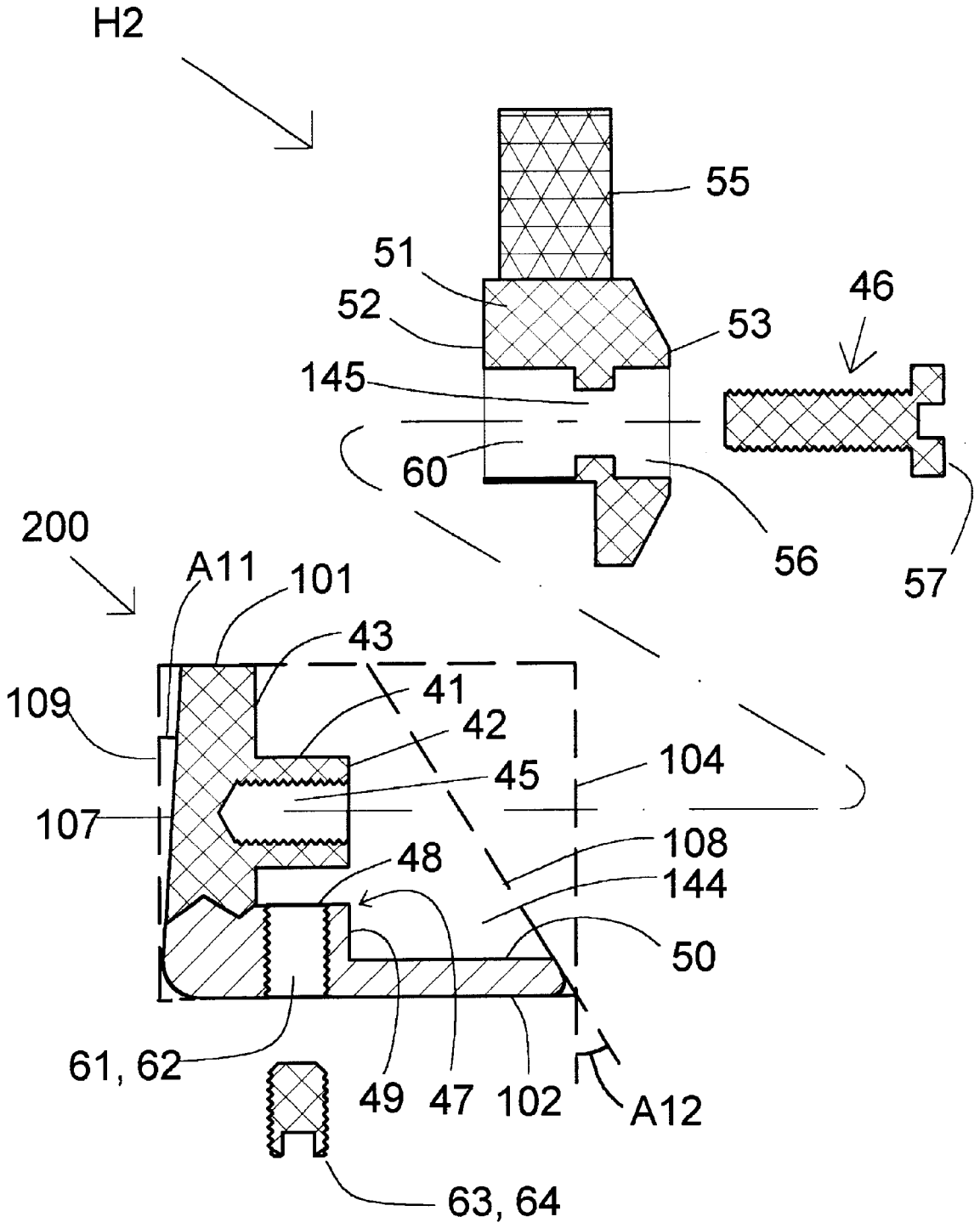
FIG. 7 shows a side view of the second embodiment of the putter head and the adjustment means.

FIGS. 7–12 illustrates a second embodiment of the present invention. A golf putter 203 having adjustable capabilities, comprising a putter head 200 having a top surface 101, a bottom surface 102, a front planar surface 109, and a rear planar surface 104. The top surface 101 is generally parallel to the bottom surface 102 and the front planar surface 109 is generally parallel to the rear planar surface 104. The front planar surface 109 and rear planar surface 104 are perpendicular to the top and bottom surfaces 101 and 102. The putter head 200 further having an outer forward portion generally known as the toe 105 and inner portion generally known as the heel 106 and all the surfaces 101, 102, 109 and 104 extend from heel 106 to toe 105. Also, as shown in FIG. 7, the putter head 200 is slightly rounded where the bottom surface 102 intersects with the front planar surface 109.

The putter head 200 is constructed to have a striking surface 107 on the front planar surface 109 side and forms an angle All of approximately three degrees with respect to the front planar surface 109. A rear surface 108 is formed opposite the striking surface 107 by a rear planar cut with a rear angle A12 of thirty five degrees. It should be noted that the angles of the striking surface 107 and the rear surface 108 are not a limitation of the invention. A rear side cavity 144 is formed into the rear surface 108 of the putter head 200 and is of a symmetrical shape with respect to a vertical axis. The cavity 144 is formed at the midpoint of the putter head 200 wherein the midpoint of the cavity 144 is aligned with the midpoint of the putter head 200. The cavity 144 alters the aesthetic value and distributes the putter head's 200 weight to the outside of the "sweet spot."

A cylindrical protrusion 41 having a outer surface 42 extends outward away from an inner wall 43 of the rear side cavity 144. The center of the cylinder 41 is generally fixed at the center of the putter head 100. A threaded center axle hole 46 for receiving an axle bolt 46 is formed into the cylinder protrusion 41. A step 47 having an upper face 48 and an outward face 49, representing the width and the height of the step 47 respectively, is formed at the intersection of the inner wall 43 and a bottom surface 50 of the rear side cavity 144. The upper face 48 extending upward such that the height of the step 47 is generally half the distance from the bottom surface 50 to the center of the cylindrical protrusion 41. A significant advantage is achieved by providing the extension of the upper face 48 such that the rotation of adjustment means is automatically limited to be within the specification of the major golf associates. The extension of the outward face 49 will be described later in the description.

Figure 8:
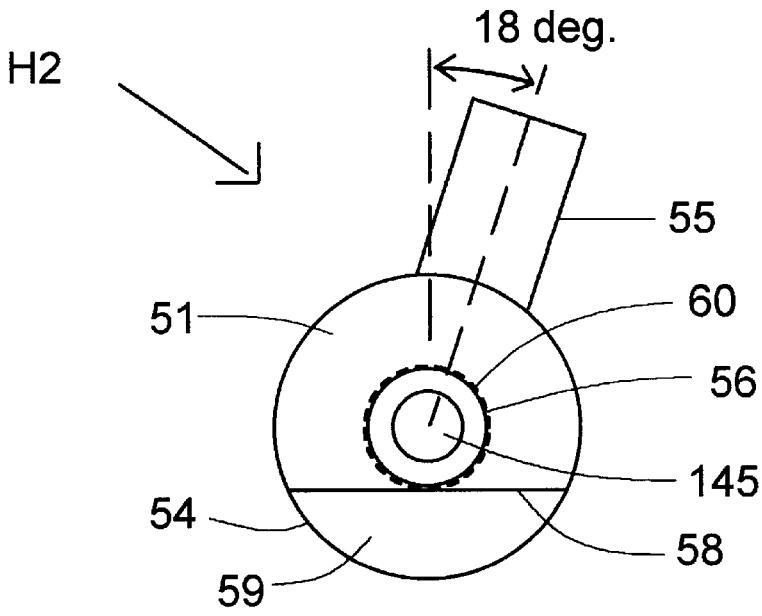
FIG. 8 shows a front view of the second embodiment of the adjustment means with a disk.
Figure 9:
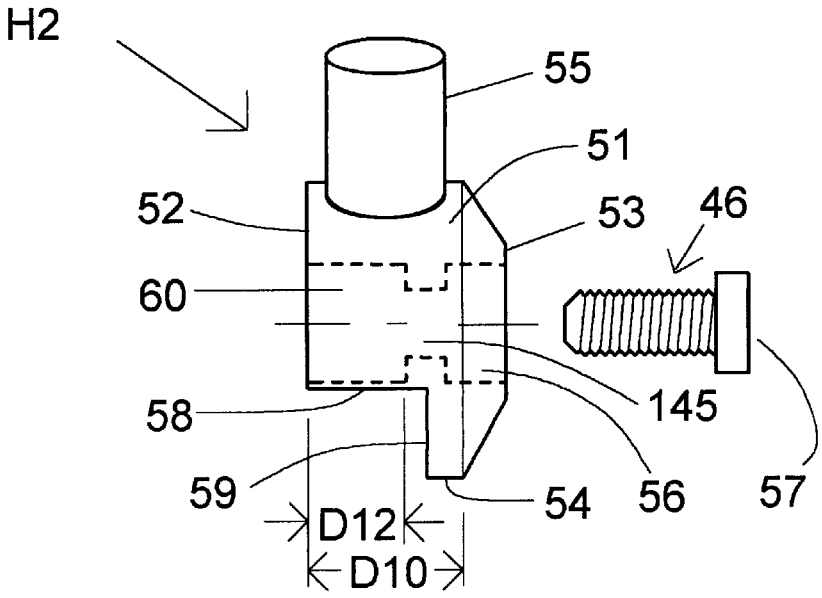
FIG. 9 shows a side view of the second embodiment of the adjustment means.
Figure 10:
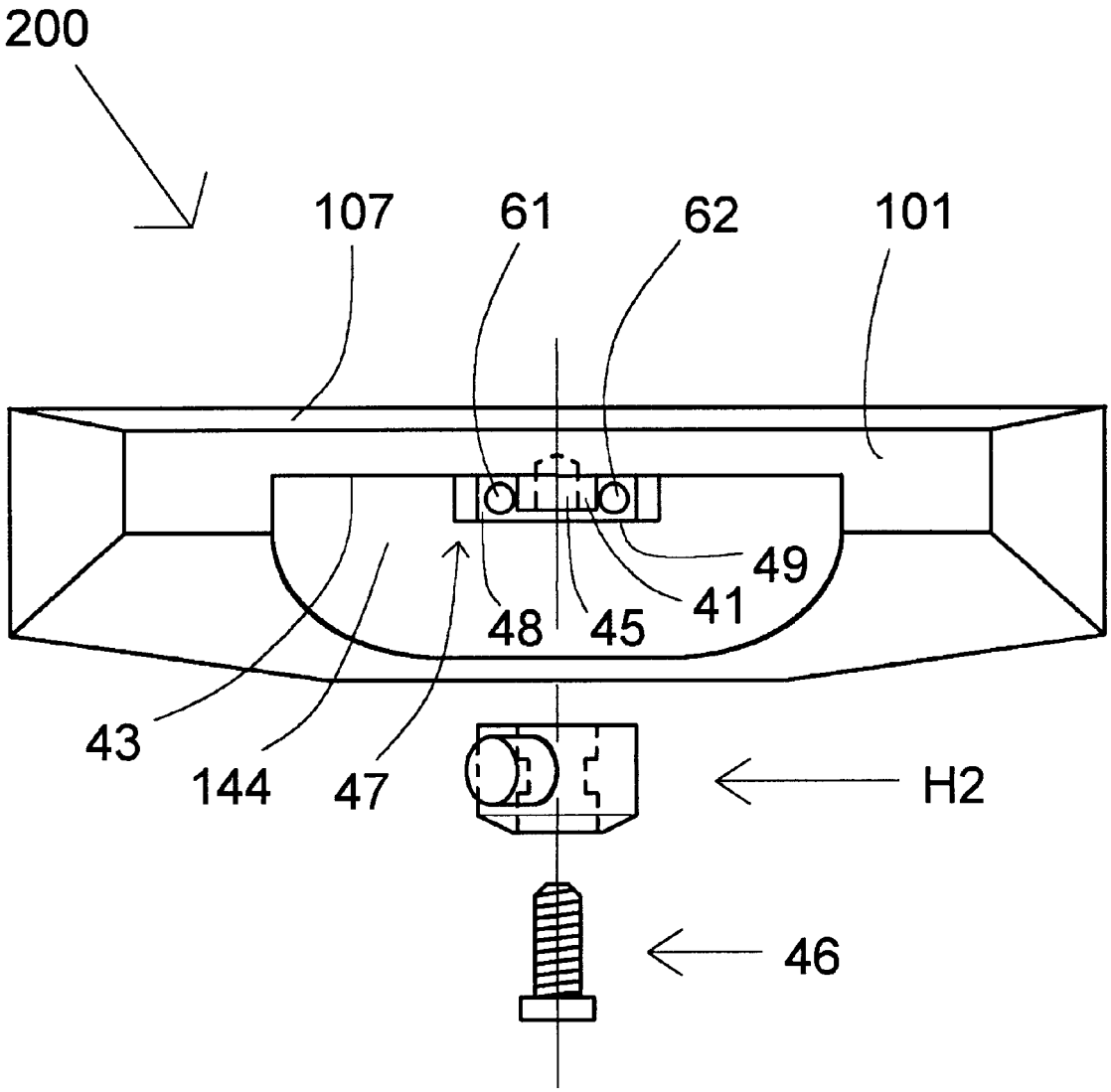
FIG. 10 shows a top view of the second embodiment of the putter head and the adjustment means with a disk.
Figure 11:
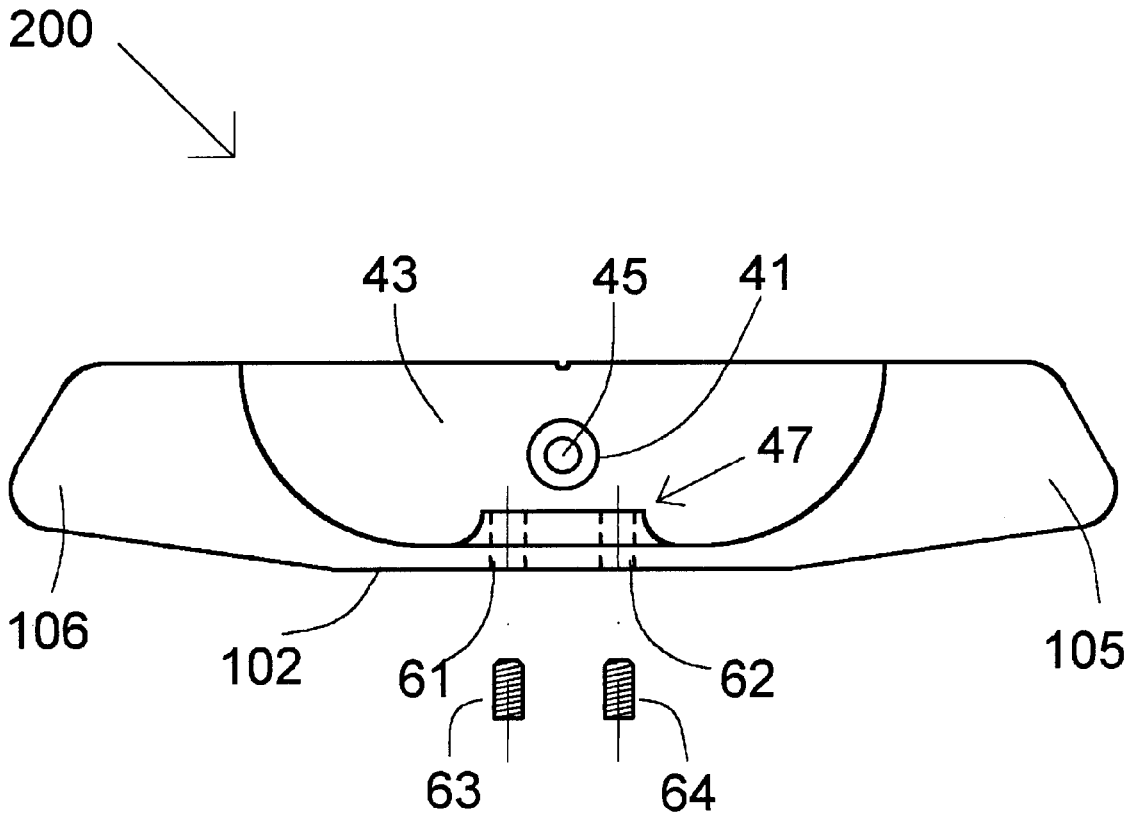
FIG. 11 shows a back view of the second embodiment of the putter head.
Figure 12:
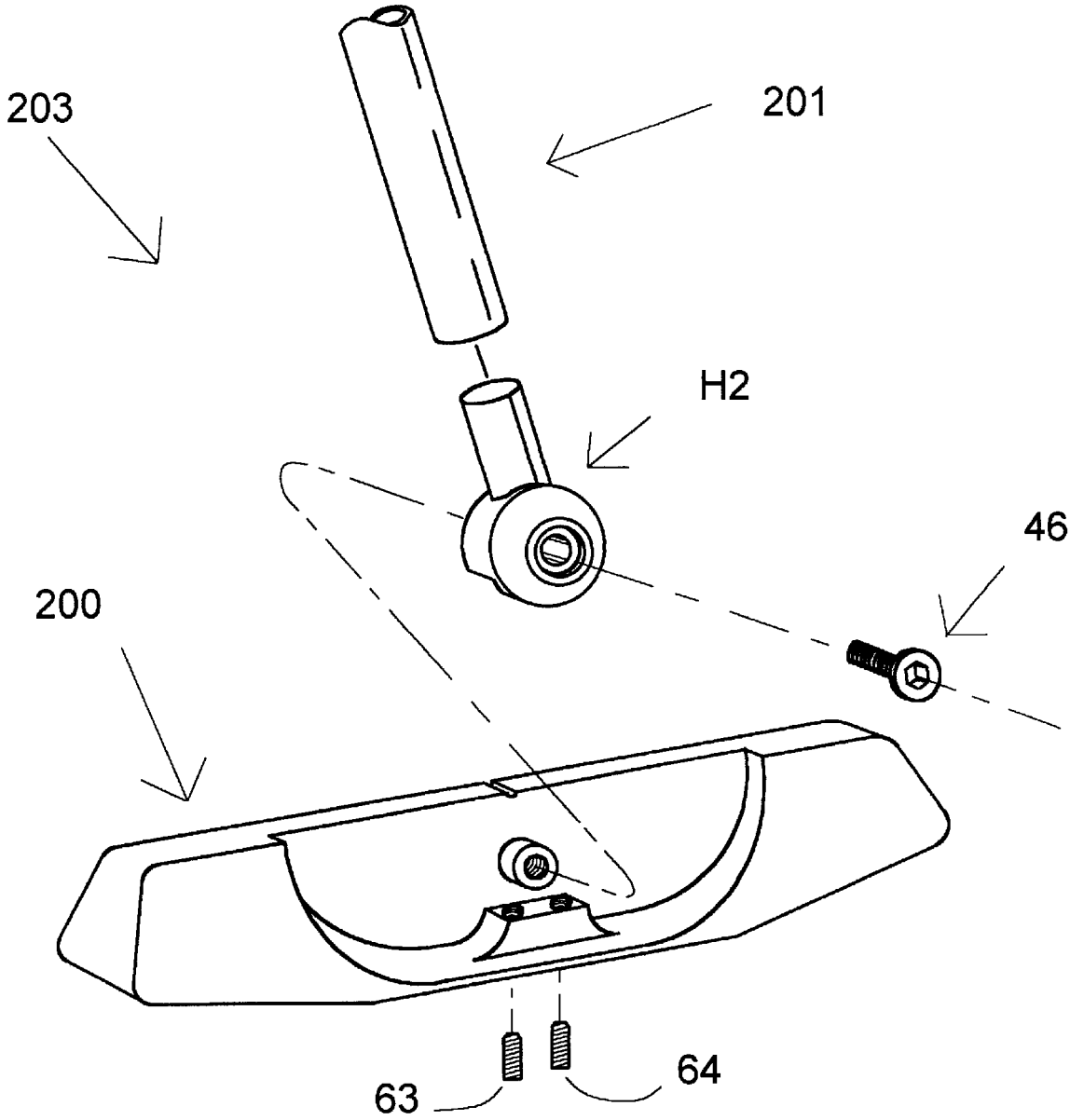
FIG. 12 shows a golf putter assembled with the second embodiment.

FIGS. 7–9 show an adjustment means H2 comprising a circular disk 51 having an inner face 52, an outer face 53, depth D10 and a radial surface 54 is shown in FIGS. 9 and 10. A 45 degree cut is provided around the circumference of the disk 51 on the outer face. The radius of the disk 51 is slightly less than the distance between the center axis of cylindrical protrusion 41 and the bottom surface 50 of the rear side cavity 144. The disk 51 is comprised of a cylindrical post 55 which extends a slight distance from the disk's 51 radial surface 54 such that the post's 55 center axis perpendicularly bisects the disk's 51 center axis. The diameter of the post 55 is slightly less then the width of the disk 51 and is sized to be received inside a shaft 201 of the golf club.

The disk 51 is comprised of a center axle hole 145 which is sized to receive the axle bolt 46 and is formed at the center of the disk 51. A countersunk portion 56 is formed at the outer face 53 of the disk's 51 center such that the top side 57 of the axle bolt 46 is flush with outer face 53 of the disk 51 when the axle bolt 46 is fully inserted.

First and second planar cuts are formed on the disk 51 which represent a horizontal face 58 and a vertical face 59 respectively. These planar cuts are formed opposite to the post 55 and at the inner face 52 of the disk 51 and the cuts are perpendicular to the each other. Also, the planar cuts are formed such that the post 55 is rotated eighteen degrees, towards the heel of the putter head 200, from an otherwise vertical position. The horizontal face 58 is perpendicular to the inner face 52 and extends inward from inner face 52 of the disk 51 to slightly over half the depth D10 of the disk 51. The vertical face 59 extends upward from the radial surface 54 and terminates at the intersection of the horizontal face 58, such that the distance from the radial surface 54 to the point of termination provides a systematic lock within the specifications of the USGA when mated with the putter head.

A cylindrical cavity 60 is formed at the center of the disk 51 on the inner face 52 to receive the cylindrical protrusion 41 which is extended from the inner wall 43 of the rear side cavity 144 of the putter head 200. The depth D12 of the cylindrical cavity 60, the length of cylindrical protrusion 41, and the extension of the outer face 49, are sized such that when the cylindrical protrusion 41 is received inside the cylindrical cavity 60, the vertical face 59 of the disk 51 is flush with outer face 49 of the step 47. The depth D10 of the disk 51 is defined such that the required depth D12 of the cylindrical cavity 60 does not join the countersink portion 56 of the disk 51.

A rotation locking means comprises two threaded lock holes 61 and 62 which are formed at the bottom surface 102 of the putter head 200 for receiving lock screws 63 and 64. The lock holes 61 and 62 are perpendicular to the bottom surface 102 of the putter head 200 and travel through the bottom surface 102 of the putter head 200 to the horizontal face 58 of the step 47. The lock holes 61 and 62 are positioned so that they are slightly to the right and left of the cylindrical protrusion 41 and are generally half the extension of outer face 49 of the step 47. The use of the rotation locking means will aid the user from losing the adjustment and prevent the twisting of the putter head 200.

In this embodiment, the lie adjustable putter head 200 is assembled by inserting the axle bolt 46 from the outer face 53 of the disk 51, through the axle hole 145 of the disk 51 and threaded in the center axle hole 45 of the cylindrical protrusion 41 of the putter head 200. The connection between a shaft 201 and the adjustment means H2 is such that the pole 55 of adjustment means H2 is inserted into the hollowing of the shaft 201. The type shaft 201 used is a preference of the manufacturer or the user of the lie adjustable putter 203.

To customize the lie of the putter 203, the user would loosen the axle bolt 46 then tighten or loosen the lock screws 63 and 64 based on the lie preference of the user. The adjustment can be made using both lock screws 63 and 64, thereby the user is able to adjust the lie to less than one degree of adjustment. Once the proper adjustment is made, the user would simply tighten the axle bolt 46. Another advantage of the these lock screws 63 and 64, is that the adjustment is maintained through final tightening of the adjustment means to the putter head 200.

DETAILED DESCRIPTION OF THE THIRD EMBODIMENT

Figure 13:
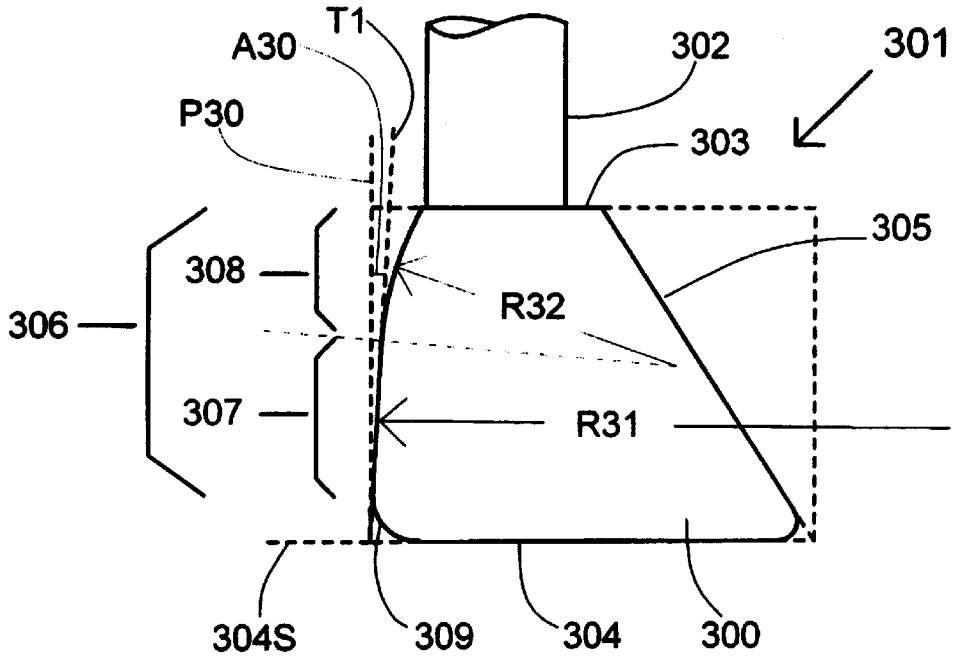
FIG. 13 shows a side view of the third embodiment of the putter head.
Figure 14:
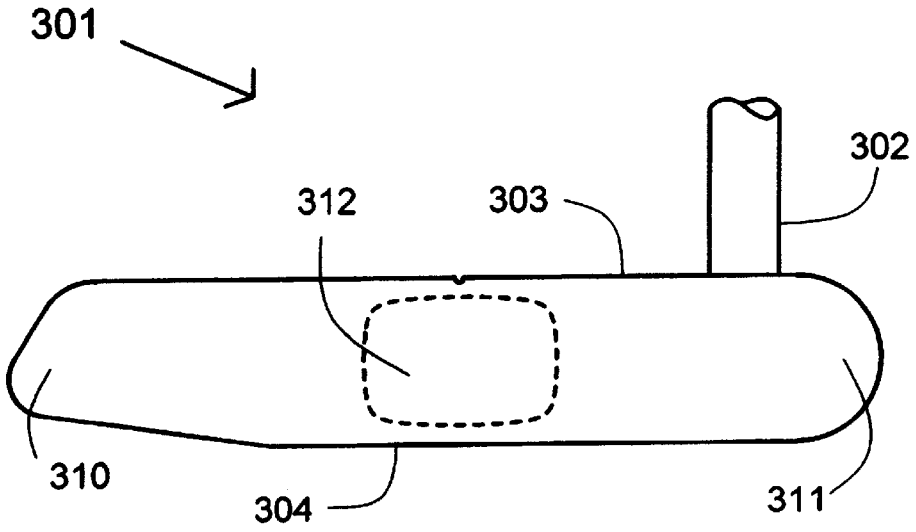
FIG. 14 shows a fromt view of the golf putter with the third embodiment.

FIGS. 13–14 shows a third embodiment of a golf putter 301 comprising a putter head 300 having a top surface 303, bottom surface 304, a striking surface 306 and rear surface 305 and a shaft 302 extended from the top surface 303. The top surface 303 is parallel to the bottom surface 304. The striking surface 306 extends form the top surface 303 to the bottom surface 304 and on the opposite side, the rear surface 305 extends from the top surface 303 to the bottom surface 304. The putter head 300 having an toe portion 310 and heel portion 311. The top surface 303, the bottom surface 304, striking surface 306 and the rear surface 305 extend from the heel portion 311 to the toe portion 310.

FIG. 13 shows the preferred embodiment of the striking surface 306 having dual faces, a first face 307 and a second face 308 and a leading edge 309. The first face 307 having a first curvature radius R31 which extends from the leading edge 309 to the second face 308. The tangent of the first curvature radius R31 at the intersection of the first face 307 and the leading edge 309 may never be greater than 90 degrees with respect to the bottom surface 304. In the preferred embodiment the first face 307 has an infinite radius for the first curvature radius R31 so that it is completely flat. The first face 307 is also lofted at a slight angle A30, zero or greater than zero degrees, with respect to a perfectly vertical plane P30. The second face 308 has a second curvature radius R32 which is less than or equal to the first curvature radius R31 of the first face 307. If, however, the first curvature radius R31 is equal to infinity than the second radius R32 must be much less than infinity since to have both radii equal to infinity would result in a flat face. The second face 308 extends from the first face 307 to the top surface 303. The interface of the first face 307 and the second face 308 is a smooth, piece-wise connection such that the tangent line of the second face 308, at the intersection of the two faces, lays within the plane of the first face if the first face 307 is flat. The leading edge 309 is slightly rounded so that it will not catch on any putting surfaces.

Figure 15:
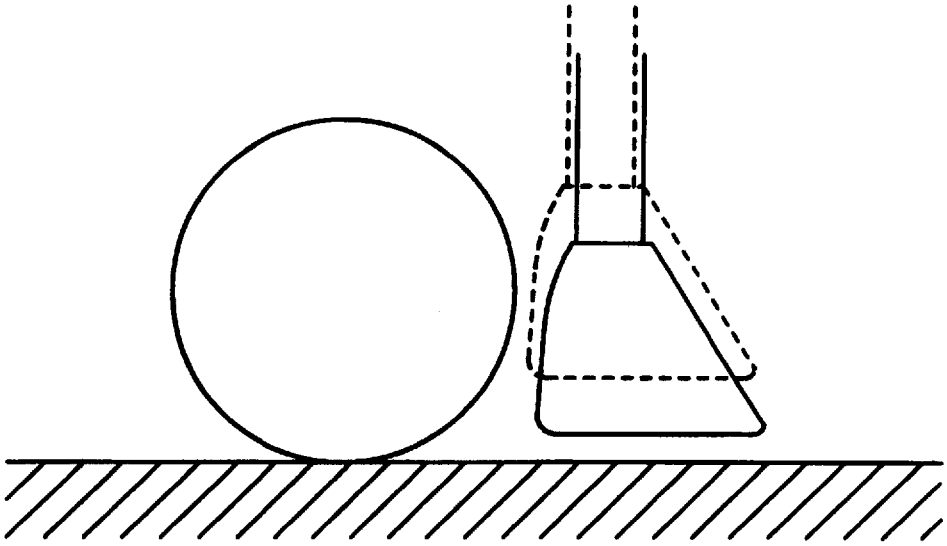
FIG. 15 shows a putting set up with a varied putter head level from the putting surface.
Figure 16:
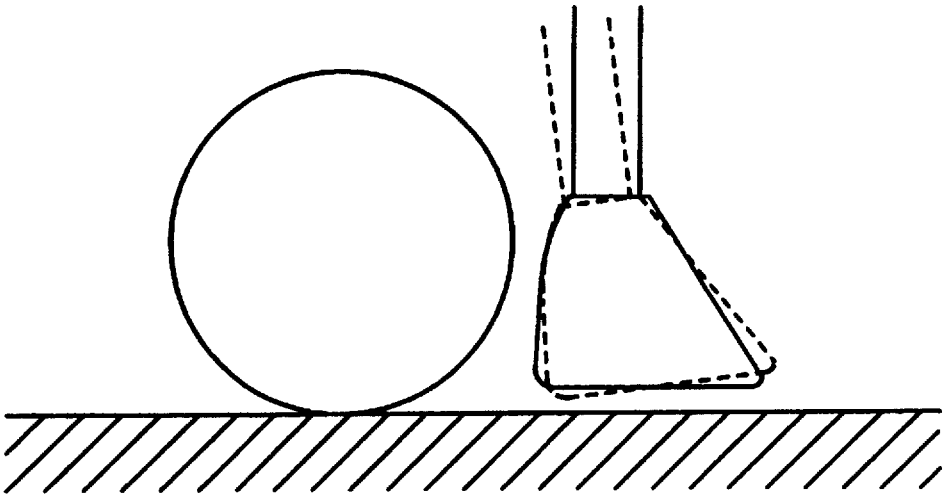
FIG. 16 shows a tilted putter face (dotted line) vs a proper vertical putter face position (solid line).

The most significant aspect of the invention is a tangent of the first face 307 and a tangent of the second face 308 at the interface between the first face 307 and the second face 308 are in the same plane such that the faces are smooth and continuous. This transition of first face 307 and second face 308 will allow a golfer to utilize the sweet spot area 312 of the putter head 300 most effectively, regardless of stroke type. For example, when the golfer strikes the ball using a proper stroke, the first face 307 is utilized as a sweet spot and the loft angle is not sensitive of the putter head level from the putting surface as shown in FIG. 15. If, however, the golfer strikes the ball with the hands pushed forward too much and the striking surface is tilted forward, then the second face 308 is automatically utilized as the sweet spot and retains the proper loft angle to provide a roll as shown in FIG. 16. It should be noted that proportions of the area covered by the faces 307 and 308 are not a limitation and is manufacturers preference.

The preferred material for all the parts of the present invention is steel, although other materials may be substituted without deviating from the spirit of the invention. Specially, materials in the sweet spot area 312 may be substituted with any foreign materials such as plastics, composite materials, etc.

Because many varying and different embodiments may be made within the scope of the present invention concept, and because many modifications may be made in the present inventions, it is to be understood that the above detailed description should be interpreted as illustration and not in a limiting sense. The spirit of the present invention being limited solely by the appended claims.

What is claimed is:

1. A golf putter comprising, a) a putter head having a striking surface, a top surface and a rear surface;

b) a shaft attached to the putter head;

c) a cylindrical protrusion extended from an inner wall of a rear side cavity formed at the rear surface of the putter head; the cylinder protrusion comprises, an outer surface and an axis hole formed therein;

d) an adjustment means to adjust the putter head, is secured to the putter head over the cylindrical protrusion by the use of an axis bolt; the adjustment means further comprises a disk; the disk having a cavity, sized to receive the cylindrical protrusion, and an axle hole to receive the axle bolt; the disk further comprises an inner face, an outer face, a radial surface; a horizontal face and a vertical face are formed a the radial surface and the inner face of the disk, respectively; and e) a rotation locking means for controlling the rotation of the adjustment means.

2. A golf putter as claimed in claim 1, wherein:

a) a pole is extended from the disk whereby the shaft is attached to the pole; and b) the pole is extended from the radial surface of the disk.

3. A golf putter as claimed in claim 1, wherein:

the horizontal face and the vertical face are sized and aligned to limit the rotation of the shaft.

4. A golf putter as claimed in claim 1, wherein:

the rotation locking means comprises a plurality of locking holes formed at the bottom surface of the putter head; and a plurality of locking screws are received through the locking holes formed at the bottom surface.

5. A golf putter as claimed in claim 4, wherein the rotation locking means comprising two lock screws received through two lock holes formed at the bottom surface of the putter head.

6. A golf putter, comprising:

a) a putter head having a striking face; the striking face having a pocket;

b) the pocket having an axle hole for receiving an axle bolt;

c) a shaft attached to the putter head;

d) an adjustment means for adjusting the putter head; the adjustment means is secured into the pocket of the putter head by the axle bolt; and e) a rotation locking means for controlling the rotation of the adjustment means.

7. A golf putter as claimed in claim 6, wherein: the adjustment means having a pole for receiving a shaft.

8. A golf putter as claimed in claim 7, wherein the adjustment means further comprises a disk; and the pole extending from the disk.

9. A golf putter as in claim 8, wherein:

the disk comprises an inner face, and an radial surface; and the disk sized slightly less than the pocket.

10. A golf putter as in claim 9, wherein:

the pocket having an opening at the top surface of the putter head to receive the pole which is attached to the disk of the adjusting means.

* * * * *